US009541854B2

(12) United States Patent
Kikuchi et al.

(10) Patent No.: US 9,541,854 B2
(45) Date of Patent: Jan. 10, 2017

(54) ELECTROCONDUCTIVE MEMBER FOR ELECTROPHOTOGRAPHY, PROCESS CARTRIDGE, AND ELECTROPHOTOGRAPHIC APPARATUS

(71) Applicant: CANON KABUSHIKI KAISHA, Tokyo (JP)

(72) Inventors: Yuichi Kikuchi, Susono (JP); Kazuhiro Yamauchi, Suntou-gun (JP); Mikio Shimada, Tokyo (JP); Tetsuo Hino, Yamato (JP); Masahiro Watanabe, Mishima (JP); Norifumi Muranaka, Yokohama (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 91 days.

(21) Appl. No.: 14/666,242

(22) Filed: Mar. 23, 2015

(65) Prior Publication Data

US 2015/0198905 A1 Jul. 16, 2015

Related U.S. Application Data

(63) Continuation of application No. PCT/JP2014/004857, filed on Sep. 22, 2014.

(30) Foreign Application Priority Data

Sep. 27, 2013 (JP) ..... 2013-202663

(51) Int. Cl.
*G03G 15/02* (2006.01)
*G03G 15/14* (2006.01)

(52) U.S. Cl.
CPC ..... *G03G 15/02* (2013.01); *G03G 15/0233* (2013.01); *G03G 15/14* (2013.01);
(Continued)

(58) Field of Classification Search
CPC .... G03G 15/0233; G03G 15/02; G03G 15/14; G03G 15/0818; G03G 15/168; D01D 5/0007; F16C 13/00; D10B 2401/16; Y10T 428/2495
See application file for complete search history.

(56) References Cited

U.S. PATENT DOCUMENTS 4,922,299 A 5/1990 Uchimoto et al.
6,701,105 B2 3/2004 Funabashi
(Continued)

FOREIGN PATENT DOCUMENTS

JP 2-28669 A 1/1990
JP 7-140755 A 6/1995
(Continued)

OTHER PUBLICATIONS

International Preliminary Report on Patentability, International Application No. PCT/JP2014/004857 Mailing Date Apr. 7, 2016.
(Continued)

*Primary Examiner* — Jason L Vaughan
(74) *Attorney, Agent, or Firm* — Fitzpatrick, Cella, Harper & Scinto

(57) ABSTRACT

Provided is an electroconductive member configured to suppress a void image caused by abnormal discharge and a horizontal streak-like image caused by downstream discharge without depending on the thickness of a photosensitive layer of a photosensitive drum over a long period of time. The electroconductive member for electrophotography comprises at least an electroconductive support and a surface layer formed on an outer side of the electroconductive support. The surface layer includes a porous body and satisfies the predetermined (1), (2), and (3).

9 Claims, 3 Drawing Sheets

(52) U.S. Cl.
CPC ..... *G03G 2215/00957* (2013.01); *Y10T 428/249953* (2015.04)

(56) References Cited

U.S. PATENT DOCUMENTS

| | | | | |
|---|---|---|---|---|
| 7,374,639 | B2 * | 5/2008 | Ampulski | D21F 1/0036 162/116 |
| 7,917,064 | B2 * | 3/2011 | Nagamori | G03G 15/0233 399/176 |
| 8,257,641 | B1 * | 9/2012 | Qi | G03G 15/2057 264/172.15 |
| 8,265,525 | B2 * | 9/2012 | Wada | G03G 15/0233 399/176 |
| 8,532,535 | B2 * | 9/2013 | Nose | G03G 15/0233 399/176 |
| 8,574,713 | B2 * | 11/2013 | Rutledge | D01D 5/0038 428/292.1 |
| 8,725,043 | B2 * | 5/2014 | Hoshio | G03G 15/0233 399/176 |
| 9,176,414 | B2 * | 11/2015 | Sato | G03G 15/0233 |
| 9,234,300 | B2 * | 1/2016 | Law | D01D 5/0007 |
| 9,274,496 | B2 * | 3/2016 | Miyagawa | G03G 21/18 |
| 2010/0054821 | A1 | 3/2010 | Jung et al. | |
| 2010/0291182 | A1 * | 11/2010 | Palasis | A61K 9/0024 424/426 |
| 2010/0297906 | A1 * | 11/2010 | Steckl | D01D 5/0084 442/347 |
| 2012/0224897 | A1 * | 9/2012 | Qi | B82Y 30/00 399/333 |
| 2015/0093151 | A1 | 4/2015 | Muranaka et al. | |
| 2015/0132024 | A1 | 5/2015 | Watanabe et al. | |
| 2015/0198900 | A1 | 7/2015 | Yamada et al. | |
| 2015/0198904 | A1 | 7/2015 | Kikuchi et al. | |

FOREIGN PATENT DOCUMENTS

| | | | |
|---|---|---|---|
| JP | 2003-66807 | A | 3/2003 |
| JP | 2004-37786 | A | 2/2004 |
| JP | 2008-276026 | A | 11/2008 |

OTHER PUBLICATIONS

U.S. Appl. No. 14/708,981, filed May 11, 2015. Inventor: Yamada, et al.

U.S. Appl. No. 14/715,477, filed May 18, 2015. Inventor: Yamaguchi, et al.

U.S. Appl. No. 14/715,033, filed May 18, 2015. Inventor: Yamaguchi, et al.

International Search Report dated Dec. 11, 2014 in International Application No. PCT/JP2014/004857.

* cited by examiner

ELECTROCONDUCTIVE MEMBER FOR ELECTROPHOTOGRAPHY, PROCESS CARTRIDGE, AND ELECTROPHOTOGRAPHIC APPARATUS

CROSS-REFERENCE TO RELATED APPLICATIONS

This application is a continuation of International Application No. PCT/JP2014/004857, filed Sep. 22, 2014, which claims the benefit of Japanese Patent Application No. 2013-202663, filed Sep. 27, 2013.

BACKGROUND OF THE INVENTION

1. Field of the Invention

The present invention relates to an electroconductive member for electrophotography, a process cartridge, and an electrophotographic apparatus.

2. Description of the Related Art

In an electrophotographic apparatus as an image forming apparatus adopting an electrophotographic system, an electroconductive member is used as a charging member or a transfer member. Such electroconductive member is required to maintain suitable electrical characteristics over a service life of the electrophotographic apparatus.

From the viewpoint of controlling the electrical characteristics of the electroconductive member within a suitable range, an electron conductive agent such as carbon black and an ion conductive agent such as a quaternary ammonium salt have been used for resistance control. However, for example, in the case where the electroconductive member is used as the charging member over a long period of time, even when local resistance unevenness is small, there is a risk in that an electric field is concentrated in the local portion with resistance unevenness to cause abnormal discharge, and consequently, a void image may be generated. Further, when the resistance of the electroconductive member increases with long-term use, discharge (hereinafter sometimes referred to as "downstream discharge") occurs on a downstream side of an abutment portion between the electroconductive member and the body to be charged, and consequently, a horizontal streak-like image may be generated.

As described above, it is not easy to maintain suitable electrical characteristics over a long period of time. As a method of maintaining the electrical characteristics of the electroconductive member, the following methods are disclosed. Japanese Patent Application Laid-Open No. 2008-276026 discloses a method involving dispersing roughening particles in a surface layer of the charging member so as to form surface irregularities. Further, Japanese Patent Application Laid-Open No. H07-140755 discloses a method involving providing a non-electroconductive two-dimensional mesh on a surface of the charging member.

SUMMARY OF THE INVENTION

The charging member as an example of the electroconductive member causes discharge between the charging member and a photosensitive drum so as to charge a photosensitive layer on a surface of the photosensitive drum. When the charging member has local resistance unevenness, abnormal discharge may occur. Further, when the resistance of the charging member increases with long-term use, downstream discharge may occur. In particular, in the case where the life of the charging member is to be increased, because of the resistance unevenness of the charging member and a significant variation in the thickness of the photosensitive layer between an initial period of printing and a period after printing of a large number of sheets during long-term use, it is not easy to form a satisfactory image over a long period of time. Specifically, problems described below may occur.

First, there is a case in which abnormal discharge occurs in the electroconductive member due to the local resistance unevenness so as to generate a void image. This phenomenon can be presumed to occur as follows. When the electroconductive member has local resistance unevenness, an electric field in a discharge void increases due to the resistance unevenness. As a result, a discharged charge amount increases to generate a void image caused by abnormal discharge. In particular, in a low-temperature and low-humidity environment (hereinafter referred to as "L/L environment"), the resistance of the charging member increases so that it is necessary to increase a charging voltage, and hence the void image may be generated significantly.

On the other hand, the resistance of the electroconductive member increases along with use, and a horizontal streak-like image caused by downstream discharge may be generated. This phenomenon can be presumed to occur as follows. In general, a surface of the photosensitive layer receives a sufficient discharged charge amount only with discharge on an upstream side of the abutment portion, and thus, an image is formed. However, when the electroconductive member is exposed to discharge over a long period of time, a surface of the electroconductive member is oxidized to increase the resistance. As a result, an electric field is weakened on the upstream side of the abutment portion, and the discharged charge amount decreases. Therefore, the condition for causing discharge is satisfied on a downstream side of the abutment portion so that a horizontal streak-like image is generated. In particular, in the L/L environment, the resistance of the charging member increases significantly, and the horizontal streak-like image may become more conspicuous.

In the transfer member as another example of the electroconductive member, which charges, by discharge, the photosensitive layer on the surface of the photosensitive drum or paper in the electrophotographic apparatus, a void image caused by abnormal discharge may also be generated due to the local resistance unevenness.

As described above, the discharge characteristics of the charging member or the transfer member are significantly influenced by the electrical characteristics of the electroconductive member. It is expected that the life of the electrophotographic apparatus increases rapidly in the future, and hence it is considered to be urgently required to provide an electroconductive member capable of suppressing abnormal discharge and downstream discharge. However, the discharged charge amount needs to be suppressed so as to suppress abnormal discharge, whereas the discharged charge amount on the upstream side of the abutment portion needs to be increased so as to suppress downstream discharge. Thus, it is not easy to satisfy both the demands simultaneously. In order to satisfy both the demands, the following methods are disclosed.

In Patent Application Laid-Open No. 2008-276026, the roughening particles are dispersed in the surface layer of the charging member so as to provide an irregular shape to the charging member. When the surface of the charging member has an irregular shape, discharge occurs preferentially in a convex portion separately from discharge in a flat portion in terms of time. Thus, abnormal discharge is less liable to occur. However, when the thickness of the photosensitive layer of the photosensitive member increases, and the charging voltage is increased so as to increase the discharged charge amount, the local concentration of an electric field in the convex portion rather causes abnormal discharge, with the result that a void image may be generated.

Japanese Patent Application Laid-Open No. H07-140755 discloses a configuration in which, in order to suppress vibration sound in AC charging, the charging member and the photosensitive drum are brought into contact with each other through a non-electroconductive two-dimensional mesh so as to cause discharge in a through hole. However, the non-electroconductive mesh cannot be discharged, and hence it is necessary to increase the charging voltage so as to accelerate the diffusion of discharge, thereby compensating for a charging defect with the discharge in a pore portion. On the other hand, when the discharged charge amount is increased, abnormal discharge occurs in the through hole in this case, with the result that a void image may be generated.

The present invention has been achieved in view of the above-mentioned technical background, and the present invention is direct to providing an electroconductive member capable of suppressing abnormal discharge and downstream discharge and forming a satisfactory image even when the electrophotographic apparatus is used over a long period of time. Further, the present invention is direct to providing a process cartridge and an electrophotographic apparatus capable of suppressing a void image and a horizontal streak-like image over a long period of time.

According to one aspect of the present invention, there is provided an electroconductive member for electrophotography, comprising at least: an electroconductive support; and a surface layer formed on an outer side of the electroconductive support, in which the surface layer includes a porous body and satisfies the following (1), (2), and (3):

(1) the porous body has a co-continuous structure including a skeleton that is three-dimensionally continuous and a pore that is three-dimensionally continuous;

(2) when an arbitrary square region having one side length of 150 μm of a surface of the surface layer is photographed, and the region is equally divided into 60 parts vertically and equally divided into 60 parts horizontally so that the region is equally divided into 3,600 square parts, a ratio of a total sum of the number of the square parts formed of the skeleton and the number of the square parts formed of the pore with respect to the number of all the square parts is 25% or less; and (3) the porous body is non-electroconductive.

According to another aspect of the present invention, there is provided a process cartridge comprising the electroconductive member according to claim 1, wherein the process cartridge is detachably mountable to a main body of an electrophotographic apparatus.

According to further aspect of the present invention, there is provided an electrophotographic apparatus, comprising the electroconductive member.

According to the present invention, the electroconductive member can be provided, which is capable of suppressing abnormal discharge and downstream discharge over a long period of time without being influenced by a change in thickness of the photosensitive layer on the surface of the photosensitive drum. Further, according to the present invention, the process cartridge and the electrophotographic apparatus can be provided, which are capable of suppressing the occurrence of image defects such as a void image and a horizontal streak-like image over a long period of time.

Further features of the present invention will become apparent from the following description of exemplary embodiments with reference to the attached drawings.

DESCRIPTION OF THE EMBODIMENTS

Figure 1A:
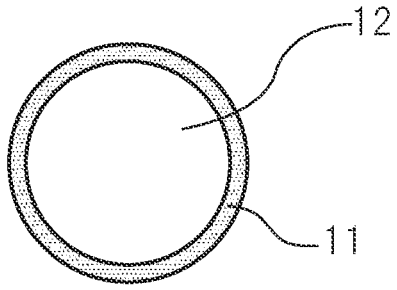
FIG. 1A is a schematic sectional view illustrating an example of an electroconductive member according to the present invention.

Preferred embodiments of the present invention will now be described in detail in accordance with the accompanying drawings.

Discharge is a diffusion phenomenon of an electron avalanche caused in accordance with the Paschen's Law, in which ionized electrons increase exponentially while repeating the process of colliding with molecules in the air and electrodes so as to generate electrons and positive ions. The electron avalanche diffuses in accordance with an electric field, and the degree of the diffusion determines a final discharged charge amount.

Abnormal discharge occurs in the case where a voltage that is excessive according to the Paschen's Law is applied and the electron avalanche diffuses significantly to produce a very large discharged charge amount. In actuality, abnormal discharge can be observed with a high-speed camera and an image intensifier and has a size of from about 200 μm to 700 μm. The discharge current amount thereof is measured to be about 100 times or more the discharge current amount of normal discharge. Thus, in order to suppress abnormal discharge, it is sufficient that the discharged charge amount generated by the diffusion of the electron avalanche be controlled within a normal range under the condition of a large applied voltage.

On the other hand, downstream discharge can be presumed to be caused as follows. Discharge has very large energy so as to oxidize a surface of an electroconductive member. In particular, when the electroconductive member is used over a long period of time, the resistance of the electroconductive member increases. As a result, discharge on an upstream side of an abutment portion between the electroconductive member and the body to be charged is reduced, and the condition under which discharge occurs is satisfied also on a downstream side of the abutment portion, with the result that a horizontal streak-like image is generated.

Downstream discharge can be observed with a high-speed camera in the same way as in abnormal discharge and appears as streak-like discharge parallel to the abutment portion. Further, downstream discharge occurs in a weak electric field as compared to discharge that occurs on the upstream side of the abutment portion and is observed as intermittent weak discharge. Thus, an image defect caused by downstream discharge appears as a horizontal streak without periodicity. That is, it is presumed that a horizontal streak-like image can be relieved by suppressing a phenomenon in which a photosensitive drum is charged due to downstream discharge.

As a result of the earnest study, the inventors of the present invention have found that abnormal discharge and downstream discharge can be suppressed simultaneously from an initial period of printing to a period after printing of a plurality of sheets by introducing a surface layer including a fine and non-electroconductive three-dimensionally co-continuous porous body into an outermost surface of the electroconductive member. The reason for this is not clear but is assumed as follows.

First, the suppression of abnormal discharge is described. It is expected that the surface layer including the porous body according to the present invention can limit the diffusion of the electron avalanche so as to reduce the discharged charge amount, and thus abnormal discharge can be suppressed so as to suppress a void image, for the following three reasons. First, a fine pore, which is complicated three-dimensionally, spatially limits the diffusion of the electron avalanche. Second, discharge can pass through the continuous pore, and hence the discharged charge amount required for forming an image can be ensured. Third, even when electrons collide with a non-electroconductive skeleton, the generation of new electrons is reduced. In actuality, as a result of the direct observation of discharge that occurs between the electroconductive member according to the present invention and the photosensitive drum with a highly sensitive camera, a phenomenon has been also confirmed in which one-shot discharge is broken up in the case where the surface layer including the porous body according to the present invention is formed on the surface of the electroconductive member.

Next, the suppression of downstream discharge is described. Downstream discharge is weak intermittent discharge that occurs in a void on the downstream side of the abutment portion and occurs simultaneously in the entire longitudinal direction of the electroconductive member. Therefore, an image defect caused by downstream discharge also appears as a horizontal streak. In the surface layer including the porous body according to the present invention, it is expected that weak discharge such as downstream discharge occurs in the porous body and cannot reach the photosensitive drum, and hence the occurrence of a horizontal streak-like image defect can be suppressed.

For the above-mentioned reasons, according to the present invention, the electroconductive member can be provided, which suppresses the occurrence of abnormal discharge and downstream discharge over a long period of time without being influenced by the thickness of the photosensitive layer on the photosensitive drum. Further, according to the present invention, the process cartridge and the electrophotographic apparatus can be provided, which are capable of suppressing a void image and a horizontal streak-like image over a long period of time. Now, the present invention is described in detail.

Figure 1B:
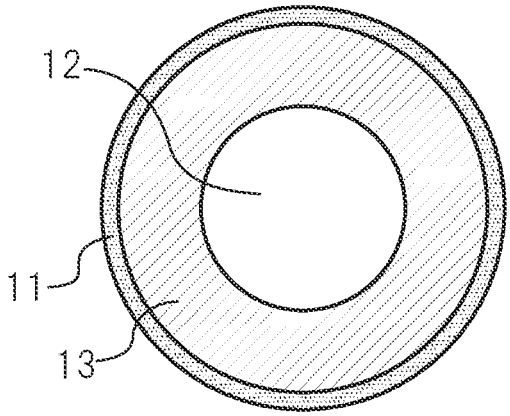
FIG. 1B is a schematic sectional view illustrating an example of the electroconductive member according to the present invention.

FIGS. 1A and 1B are sectional views of an example of a roller-shaped electroconductive member according to the present invention. The electroconductive member includes an electroconductive support and a surface layer formed on an outer side of the electroconductive support. The surface layer is formed of a porous body. As examples of a structure of the electroconductive member, there may be given configurations illustrated in FIGS. 1A and 1B.

An electroconductive member of FIG. 1A includes an electroconductive support formed of a cored bar 12 serving as an electroconductive mandrel and a surface layer formed on an outer periphery of the electroconductive support. Further, an electroconductive member of FIG. 1B includes an electroconductive support, which includes the cored bar 12 serving as an electroconductive mandrel and an electroconductive resin layer 13 formed on an outer periphery of the cored bar 12, and the surface layer 11 formed on an outer periphery of the electroconductive support. Note that, the electroconductive member according to the present invention may have a multi-layered configuration in which a plurality of the electroconductive resin layers 13 are arranged as needed as long as the effects of the present invention are not impaired. Further, the electroconductive member according to the present invention is not limited to the roller shape and may have, for example, a blade shape.

<Electroconductive Support>

The electroconductive support according to the present invention may be formed of, for example, the cored bar 12 serving as an electroconductive mandrel as illustrated in FIG. 1A. Further, as illustrated in FIG. 1B, the electroconductive support according to the present invention may be configured to have the cored bar 12 serving as an electroconductive mandrel and the electroconductive resin layer 13 formed on the outer periphery of the cored bar 12. Further, the electroconductive support according to the present invention may have a multi-layered configuration in which a plurality of the electroconductive resin layers 13 are arranged as needed as long as the effects of the present invention are not impaired.

[Electroconductive Mandrel]

As a material forming the electroconductive mandrel, one appropriately selected from materials known in the field of an electroconductive member for electrophotography can be used. For example, there is given a cylindrical material in which a surface of a carbon steel alloy is plated with nickel having a thickness of about 5 μm and the like.

[Electroconductive Resin Layer]

A rubber material, a resin material, or the like can be used as a material constituting the electroconductive resin layer 13 according to the present invention. The rubber material is not particularly limited, and a rubber known in the field of an electroconductive member for electrophotography can be used. Specific examples thereof include an epichlorohydrin homopolymer, an epichlorohydrin-ethylene oxide copolymer, an epichlorohydrin-ethylene oxide-allyl glycidyl ether terpolymer, an acrylonitrile-butadiene copolymer (NBR), a hydrogenated product of an acrylonitrile-butadiene copolymer, a silicone rubber, an acrylic rubber, and a urethane rubber. One kind of those materials may be used alone, or two or more kinds thereof may be used in combination. A resin known in the field of an electroconductive member for electrophotography can be used as the resin material. Specific examples thereof include an acrylic resin, a polyurethane resin, a polyamide resin, a polyester resin, a polyolefin resin, an epoxy resin, and a silicone resin. One kind of those materials may be used alone, or two or more kinds thereof may be used in combination. The following materials may be blended in the rubber material or resin material for forming the electroconductive resin layer in order to adjust its electrical resistance value as required: carbon black, graphite, oxides such as tin oxide, and metals such as copper and silver, which exhibit electron conductivity; electroconductive particles to each of which electroconductivity is imparted by covering its particle surface with an oxide or a metal; and ion conductive agents each having ion exchange performance such as a quaternary ammonium salt and a sulfonic acid salt, which exhibit ion conductivity. In addition, a filler, softening agent, processing aid, tackifier, anti-tack agent, dispersant, foaming agent, roughening particle, or the like that has been generally used as a blending agent for a rubber or a resin can be added to the extent that the effects of the present invention are not impaired. One kind of those agents may be used alone, or two more kinds thereof may be used in combination. Further, it is preferred that an electronically conductive resin having a volume resistivity of $1\times10^3$ Ω·cm or more and $1\times10^9$ Ω·cm or less be used as a material for forming the electroconductive resin layer 13 according to the present invention in consideration of the dependency of an electrical resistance value on an environment.

<Surface Layer>

The surface layer including the porous body according to the present invention has a feature of being formed on an outer side of the electroconductive support and satisfying the following (1), (2), and (3):

(1) the porous body has a co-continuous structure including a skeleton that is three-dimensionally continuous and a pore that is three-dimensionally continuous;

(2) when any region measuring 150 μm per side of a surface of the surface layer is photographed, and the region is equally divided into 60 parts vertically and equally divided into 60 parts horizontally so that the region is equally divided into 3,600 square parts, a ratio of a total of the number of the square parts formed of the skeleton and the number of the square parts formed of the pore with respect to the number of all the square parts is 25% or less; and (3) the porous body is non-electroconductive.

[(1)-1 Co-Continuous Structure]

The porous body according to the present invention includes a skeleton and a pore, and the pore is required to be three-dimensionally continuous so that discharged charge occurring due to discharge in the porous body reaches a surface of a photosensitive drum. In this case, the pore that is three-dimensionally continuous refers to a pore having the following two features. First, the pore connects an opening on a surface of the surface layer to a plurality of other openings. Second, the pore includes a plurality of branches and includes a plurality of portions extending from the branches to a surface of the electroconductive support. Further, in order to construct a porous body including such a pore, it is required that the skeleton be also three-dimensionally continuous. As described above, a structure in which both the pore and the skeleton are three-dimensionally continuous refers to a co-continuous structure.

When discharge occurs in the pore having the above-mentioned features, discharged charge in an amount suitable for forming an image can reach the photosensitive drum through the opening on the surface of the surface layer. On the other hand, weak discharge is completed with discharge in the pore, and hence charge generated due to downstream discharge does not reach the photosensitive drum so that a horizontal streak-like image can be suppressed.

It can be confirmed that the skeleton and the pore in the porous body are three-dimensionally continuous based on a scanning electron microscope (SEM) image obtained by a SEM or a three-dimensional image of the porous body obtained by a three-dimensional transmission-type electron microscope, an X-ray CT inspection device, or the like. That is, in order to check whether or not the porous body has a co-continuous structure, it is sufficient to confirm, in the SEM image or the three-dimensional image, that the pore connects the opening on the surface of the surface layer to the plurality of other openings and includes the plurality of branches so as to reach the electroconductive support from the branches.

[(1)-2 Sectional Shape]

It is sufficient that the porous body include the skeleton that is three-dimensionally continuous and the pore that is three-dimensionally continuous, and the sectional shape of the porous body may be a polygonal shape such as a circular shape, an oval shape, or a rectangular shape, a semi-circular shape, or any sectional shape. Of those, in order to cause discharge to occur in the pore, it is preferred that the cross section of the pore have a large number of complicated shapes. The reason for this is that the probability of the occurrence of minute discharge in the pore increases, and discharge is allowed to occur in a charge amount suitable for forming an image. Further, when discharge in the pore increases, weak discharge is completed in the pore, and downstream discharge does not occur so that a horizontal streak-like image can be suppressed.

Further, in order to limit the diffusion of the electron avalanche so as to suppress abnormal discharge while ensuring a sufficient discharged charge amount, it is preferred that the sectional shape of the pore be not circular. The electron avalanche spreads in a conical shape in accordance with an electric field, and hence the effect of limiting the diffusion of the electron avalanche is obtained by avoiding forming the pore into a circular shape, with the result that a void image caused by abnormal discharge is suppressed easily.

It is sufficient that the above-mentioned sectional shapes of the skeleton and the pore be evaluated as follows. First, a smooth cross section of the surface layer according to the present invention is produced with a microtome or the like, and the cross section is observed with an electron microscope so as to obtain a sectional image. Then, the sectional image is processed so as to obtain a binarized image. In this case, the pore in the actual porous body is three-dimensionally continuous, but the cross section of the pore in a certain sectional image has a closed shape. Further, the cross section of the pore in the binarized image is calculated for a circularity K by $L^2/4\pi S$, where L represents a perimeter of the cross section of each pore and S represents an area thereof. The circularity K indicates the complexity of the shapes of the pore and the skeleton. When the pore has a shape of a true circle, the value of the circularity K is 1. As the shape becomes complicated, the value of the circularity K increases. Note that, the units of L and S may be appropriately selected so that the unit of K is eliminated, that is, K becomes a constant.

When the pore in the binarized image is calculated for the circularity K, it is preferred that an arithmetic mean of the circularity K be 2 or more. When the arithmetic mean of the circularity K is 2 or more, the generation of a void image and a horizontal streak-like image can be suppressed as described above, and ionized electrons can be guided to the opening. It is more preferred that the arithmetic mean of the circularity K be 3 or more because the effect of suppressing the diffusion of discharge from the opening of the porous body is obtained so that a horizontal streak-like image can be further suppressed. The arithmetic mean of the circularity K is more preferably 3.5 or more, particularly preferably 4 or more. Although there is no particular limitation on the upper limit of the arithmetic mean of the circularity K, for example, the circularity K may be set to 10 or less.

Note that, the arithmetic mean of the circularity K is a value calculated by equally dividing the electroconductive member into 10 regions in a longitudinal direction, measuring any one point in each of the obtained 10 regions (10 points in total) for the circularity K, and averaging the measured circularities K.

[(2) Fineness]

It is required that the skeleton and the pore in the porous body of the surface layer according to the present invention have a fine structure. By rendering the pore fine, the diffusion of discharge in the pore can be limited so as to suppress abnormal discharge.

Figure 2:
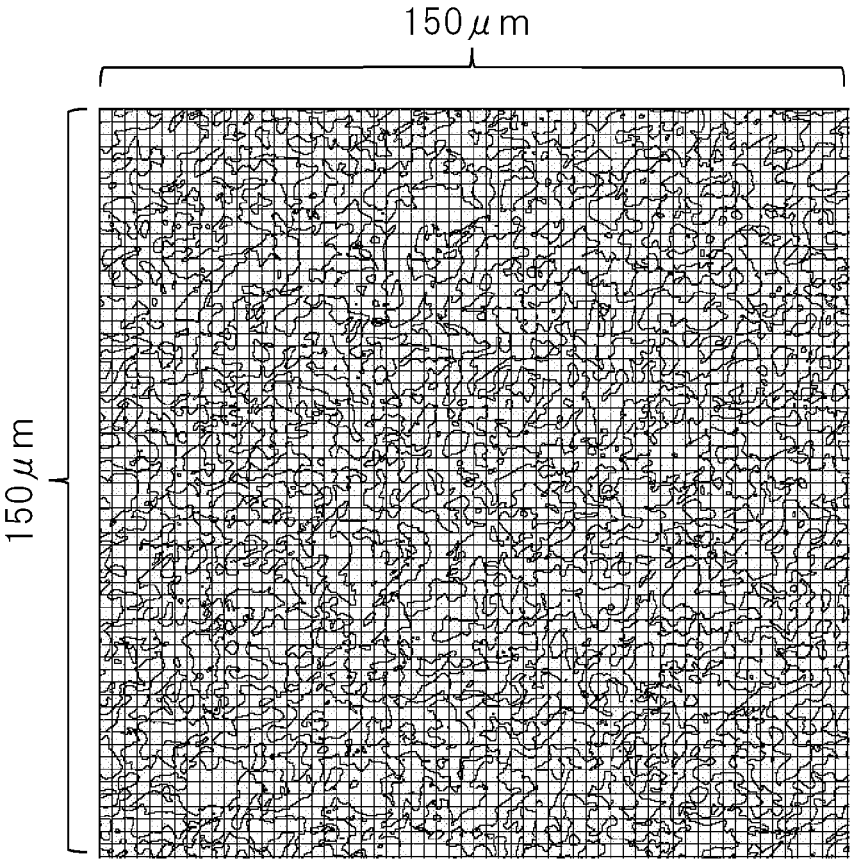
FIG. 2 is an explanatory diagram of a method of evaluating fineness in the present invention.

The fineness is evaluated as follows. First, the surface layer is observed from a direction facing the surface layer, and any region measuring 150 μm per side of the surface of the surface layer is photographed. In this case, a method capable of observing the region measuring 150 μm per side, such as a laser microscope, an optical microscope, or an electron microscope, may be appropriately used. Then, as illustrated in FIG. 2, the region is equally divided into 60 parts vertically and equally divided into 60 parts horizontally, and a total of square parts formed of the skeleton and squire parts formed of the pore is calculated. When the total is 25% or less of the entire region, the effect of limiting the diffusion of discharge in the pore is expressed so that the generation of a void image caused by abnormal discharge is relieved. It is preferred that the total of the square parts formed of the skeleton and the square parts formed of the pore be 15% or less of the entire region. In this case, the diffusion of discharge in the pore can be further limited so that the effect of suppressing the generation of a void image caused by abnormal discharge is further obtained. It is more preferred that the total of the square parts formed of the skeleton and the square parts formed of the pore be % or less of the entire region. In this case, the diffusion of discharge in the pore is further limited so that the effect of suppressing abnormal discharge is further obtained. Note that, there is no particular limitation on the lower limit of a ratio of the total with respect to the entire region, and the value of the total is preferably as small as possible.

[(3) Non-Electroconductivity]

The porous body according to the present invention is non-electroconductive, and the discharged charge amount is suppressed by the non-conductivity of the porous body. The non-electroconductivity refers to a volume resistivity of $1\times10^{10}$ Ω·cm or more. As described above, discharged charge is increased not only by the diffusion of the electron avalanche but also by the collision between the skeleton and the electrons. That is, when the porous body is non-electroconductive, electrons to be generated by the collision between the skeleton and the electrons can be reduced.

It is preferred that the surface layer have a volume resistivity of $1\times10^{10}$ Ω·cm or more and $1\times10^{17}$ Ω·cm or less. When the volume resistivity of the surface layer is set to $1\times10^{10}$ Ω·cm or more, the discharged charge amount in the pore of the porous body can be reduced so that abnormal discharge can be suppressed. On the other hand, when the volume resistivity of the surface layer is set to $1\times10^{17}$ Ω·cm or less, the generation of discharged charge required for discharge in the pore of the porous body is accelerated so that a horizontal streak-like image can be suppressed. It is more preferred that the volume resistivity of the surface layer be from $1\times10^{12}$ to $1\times10^{17}$ Ω·cm. The occurrence of discharge in the porous body can be accelerated when the volume resistivity of the surface layer is $1\times10^{12}$ Ω·cm or more, and hence a horizontal streak-like image can be further suppressed. It is more preferred that the volume resistivity of the surface layer be from $1\times10^{13}$ to $1\times10^{17}$ Ω·cm.

Note that, the volume resistivity of the surface layer is measured by the following measurement method. First, a test piece not including the pore of the porous body is taken off from the surface layer located on the surface of the electroconductive member according to the present invention with tweezers. Then, a cantilever of a scanning probe microscope (SPM) is brought into contact with the test piece, and the test piece is pinched between the cantilever and an electroconductive substrate so as to measure the volume resistivity of the surface layer. The electroconductive member is equally divided into 10 regions in a longitudinal direction. Any one point in each of the obtained 10 regions (10 points in total) is measured for the volume resistivity, and an average value of the measured volume resistivities is defined as the volume resistivity of the surface layer.

[Thickness]

Any thickness may be adopted as the thickness of the surface layer according to the present invention as long as the effects of the present invention are not impaired. Specifically, it is preferred that the thickness of the surface layer be 3 μm or more and 50 μm or less. When the thickness of the surface layer is 3 μm or more, discharge occurs in the pore of the porous body so that the effect of suppressing a void image and a horizontal streak-like image is expressed. Further, when the thickness of the surface layer is 50 μm or less, ionized electrons to be generated due to discharge in the pore are allowed to pass through the pore to reach the photosensitive drum so that an image can be formed without the occurrence of charging shortage. It is more preferred that the thickness of the surface layer be 10 μm or more and 30 μm or less. When the thickness of the surface layer is 10 μm or more, discharge in the pore increases so that the effect of suppressing the diffusion of discharge from the opening of the porous body is obtained, with the result that a horizontal streak-like image can be further suppressed. On the other hand, when the thickness of the surface layer is 30 μm or less, discharge is allowed to occur more efficiently, and image unevenness caused by thickness unevenness of the porous body can also be suppressed. It is more preferred that the thickness of the surface layer be 10 μm or more and 20 μm or less.

The thickness of the surface layer according to the present invention is confirmed as follows. A segment including the electroconductive support and the surface layer thereof is cut from the electroconductive member, and the segment is subjected to X-ray CT measurement so as to measure the thickness of the surface layer. The electroconductive member is equally divided into 10 regions in a longitudinal direction. Any one point in each of the obtained 10 regions (10 points in total) is measured for the thickness of the surface layer, and an average value of the measured thicknesses is defined as the thickness of the surface layer.

[Porosity]

Any porosity may be adopted as the porosity of the surface layer according to the present invention as long as the effects of the present invention are not impaired. Specifically, it is preferred that the porosity of the surface layer be 40% or more and 95% or less. When the porosity of the surface layer is 40% or more, discharge is allowed to occur in the pore in an amount sufficient for forming an image. Further, when the porosity of the surface layer is 95% or less, the effect of reducing the diffusion of the electron avalanche is expressed so that abnormal discharge can be suppressed, with the result that the generation of a void image can be suppressed. The porosity of the surface layer is preferably 50% or more and 93% or less, more preferably 60% or more and 90% or less.

The porosity of the surface layer according to the present invention is confirmed as follows. A segment including the electroconductive support and the surface layer is cut from the electroconductive member, and the segment is subjected to X-ray CT measurement so as to measure the porosity of the surface layer. The electroconductive member is equally divided into 10 regions in a longitudinal direction. Any one point in each of the obtained 10 regions (10 points in total) is measured for the porosity of the surface layer, and an average value of the measured porosities is defined as the porosity of the surface layer.

[Material]

There is no particular limitation on the material for the skeleton forming the porous body of the surface layer according to the present invention as long as the porous body can be formed. A polymer material such as a resin, an inorganic material such as silica or titania, a hybrid material of the polymer material and the inorganic material, or the like may be used. In this case, the polymer material refers to a material having a large molecular weight, and examples thereof include a polymer obtained by polymerizing a monomer, such as a semisynthetic polymer and a synthetic polymer, and a compound having a large molecular weight such as a natural polymer.

Examples of the polymer material may include: a (meth) acrylic polymer such as polymethyl methacrylate (PMMA); a polyolefin-based polymer such as polyethylene or polypropylene; polystyrene; polyimide, polyamide, and polyamide imide; a polyarylene (aromatic polymer) such as poly-p-phenylene oxide or poly-p-phenylene sulfide; polyether; polyvinyl ether; polyvinyl alcohol (PVOH); a polyolefin-based polymer, polystyrene, polyimide, or polyarylene (aromatic polymers) into which a sulfonic group (—$SO_3H$), a carboxyl group (—COOH), a phosphoric group, a sulfonium group, an ammonium group, or a pyridinium group is introduced; a fluorine-containing polymer such as polytetrafluoroethylene or polyvinylidene fluoride; a perfluorosulfonic acid polymer, perfluorocarboxylic acid polymer, and perfluorophosphoric acid polymer in which a sulfonic group, a carboxyl group, a phosphoric group, a sulfonium group, an ammonium group, or a pyridinium group is introduced into a skeleton of the fluorine-containing polymer; a polybutadiene-based compound; a polyurethane-based compound such as an elastomer or a gel; an epoxy-based compound; a silicone-based compound; polyvinyl chloride; polyethylene terephthalate; (acetyl)cellulose; nylon; and polyarylate. Note that, one of those polymers may be used alone, or a plurality thereof may be used in combination. In addition, the polymer may have a particular functional group introduced into its polymer chain. In addition, the polymer may be a copolymer produced from a combination of two or more kinds of monomers to be used as raw materials of those polymers.

The weight-average molecular weight (Mw) of the polymer material is not particularly limited, and is preferably 10,000 or more and 3,000,000 or less, more preferably 100,000 or more and 2,000,000 or less, still more preferably 200,000 or more and 1,000,000 or less. Note that, the weight-average molecular weight is, for example, a value measured by gel permeation chromatography (GPC).

Examples of the inorganic material include oxides of Si, Mg, Al, Ti, Zr, V, Cr, Mn, Fe, Co, Ni, Cu, Sn, and Zn. More specific examples thereof may include metal oxides such as silica, titanium oxide, aluminum oxide, alumina sol, zirconium oxide, iron oxide, and chromium oxide. One kind of those inorganic materials may be used alone, or two or more kinds thereof may be used in combination.

[Additive]

In order to adjust the electrical resistance value, an additive may be added to the material for the skeleton forming the porous body of the surface layer according to the present invention as long as the effects of the present invention are not impaired and the porous body can be formed. Examples of the additive include: carbon black, graphite, oxides such as tin oxide, and metals such as copper and silver, which exhibit electron conductivity; electroconductive particles to each of which electroconductivity is imparted by covering its particle surface with an oxide or a metal; and ion conductive agents each having ion exchange performance such as a quaternary ammonium salt and a sulfonic acid salt, which exhibit ion conductivity. One kind of those additives may be used alone, or two or more kinds thereof may be used in combination. In addition, a filler, softening agent, processing aid, tackifier, antitack agent, dispersant, or the like that has been generally used as a blending agent for a resin may be added as long as the effects of the present invention are not impaired.

[Method of Forming Surface Layer]

There is no particular limitation on a method of forming the surface layer according to the present invention as long as the surface layer including the porous body that satisfies the above-mentioned conditions (1) to (3) can be formed. Examples of the formation method may include a method involving forming a pore through use of phase separation of a polymer material solution, a method involving forming a pore through use of a foaming agent, and a method involving forming a pore by the application of an energy ray such as a laser beam.

In the porous body of the surface layer according to the present invention, it is effective that the pore and the skeleton each have a fine and complicated shape. Thus, as the method of forming the surface layer, the method using phase separation of a polymer material solution is preferred. In this case, the polymer material solution refers to a solution containing a polymer material and a solvent. As the method using phase separation of a polymer material solution, for example, there are given the following three methods.

1. A plurality of polymer materials or precursors of the polymer materials are mixed with a solvent, and the phase separation between the polymer materials is induced by changing the temperature, humidity, concentration of the solvent, compatibility between the plurality of polymer materials during polymerization of the polymer materials, and the like. Then, one of the polymer materials is removed so as to obtain a porous body in which a continuous skeleton and a continuous pore coexist. As an example, a combination of polymer materials, which are compatible with each other in a solution and become incompatible with each other after being dried, is selected. The polymer solution is applied to the electroconductive support according to the present invention, and thereafter the phase separation between the polymer materials proceeds during a drying step so that a phase-separated structure is formed. After the drying, the phase-separated structure is immersed in a selective solvent capable of dissolving one of the polymer materials. As a result of the immersion step, one of the polymer materials is eluted so as to obtain a porous structure.

2. A polymer material or a precursor of the polymer material is mixed with a solvent, and the phase separation between the polymer material and the solvent is induced by changing the temperature, humidity, concentration of the solvent, compatibility between the polymer material and the solvent during polymerization of the polymer material, and the like. Then, the solvent is removed so as to obtain a porous body in which a continuous skeleton and a continuous pore coexist.

Specifically, first, a polymer material and a solvent that are incompatible with each other at normal temperature and that are compatible with each other during heating are selected. Examples thereof include a combination of polylactic acid (polymer material) and dioxane (solvent) and a combination of polymethyl methacrylate (hereinafter sometimes referred to as "PMMA") and ethanol. Then, the polymer material and the solvent are dissolved by refluxing under heating so as to obtain a coating solution, and the electroconductive support according to the present invention is immersed in the coating solution. Then, the electroconductive support is left to stand still at normal temperature so that the phase separation between the polymer material and the solvent proceeds, with the result that a layer of the polymer material containing a solvent phase is formed around an electroconductive mandrel. Finally, the solvent is removed from the layer of the polymer material so as to obtain a porous structure formed of the polymer material.

3. A polymer material, water, a solvent, a surfactant, and a polymerization initiator are mixed so as to prepare a water-in-oil-type emulsion, and the polymer material is polymerized in the oil. Then, the water is removed so as to obtain a porous body in which a continuous skeleton and a continuous pore coexist. As an example, a precursor of a polymer material is dissolved in a non-aqueous solvent, and water and a surfactant are mixed in the solution so as to prepare an emulsion solution. Next, the electroconductive support according to the present invention is immersed in the emulsion solution. After the immersion, the polymer material in the emulsion solution is polymerized. After the polymerization, the water is evaporated during a drying step so as to obtain a porous structure.

Of those methods, the method 2 can easily freeze a structure in an initial process of phase separation. As a result, the miniaturization of the pore and the skeleton of the porous body can be performed effectively. Further, the method 2 is preferred because the method 2 can easily form a porous body having a complicated shape inherent to spinodal decomposition.

<Rigid Structural Body for Protecting Surface Layer>

The effects of the present invention are expressed due to the presence of the surface layer including the porous body according to the present invention. That is, when the porous body changes in structure, there is a risk in that discharging characteristics may also change. Thus, particularly in the case where the long-term use is intended, it is preferred that the friction and wearing between the surface of the photosensitive drum and the surface layer be reduced so as to suppress a change in structure of the porous body by introducing a rigid structural body for protecting the surface layer. In this case, the rigid structure refers to a structure that is deformed in an amount of 1 μm or less when abutting against the photosensitive drum. There is no limitation on a method of providing the rigid structure as long as the effects of the present invention are not impaired. For example, there are given a method involving forming a convex portion on the surface of the electroconductive support and a method involving introducing a separation member into the electroconductive member.

[Convex Portion on Surface of Electroconductive Support]

In the case where the electroconductive support has the configuration as illustrated in FIG. 1A, there is given a method involving processing the surface of the cored bar into a shape having a convex portion. An example thereof is a method involving forming the convex portion on the surface of the cored bar 12 by sandblasting, laser processing, polishing, or the like. Note that, the convex portion may be formed by the other methods.

In the case where the electroconductive support has the configuration as illustrated in FIG. 1B, there is given a method involving processing the surface of the electroconductive resin layer 13 into a shape having a convex portion. Examples thereof include a method involving processing the electroconductive resin layer 13 by sandblasting, laser processing, polishing, or the like, and a method involving dispersing a filler such as organic particles or inorganic particles in the electroconductive resin layer 13. As a material for forming the organic particles, there are given, for example, nylon, polyethylene, polypropylene, polyester, polystyrene, polyurethane, a styrene-acrylic copolymer, polymethyl methacrylate, an epoxy resin, a phenol resin, a melamine resin, cellulose, polyolefin, and a silicone resin. One kind of those materials may be used alone, or two or more kinds thereof may be used in combination. In addition, as a material for forming the inorganic particles, there are given, for example, silicon oxide such as silica, aluminum oxide, titanium oxide, zinc oxide, calcium carbonate, magnesium carbonate, aluminum silicate, strontium silicate, barium silicate, calcium tungstate, clay mineral, mica, talc, and kaolin. One kind of those materials may be used alone, or two or more kinds thereof may be used in combination. In addition, both of the organic particles and the inorganic particles may be used.

In addition to the above-mentioned method involving processing the electroconductive support, there is given a method involving introducing a convex portion independent from the electroconductive support. Examples thereof include a method involving applying fine powder to an outer peripheral surface of the electroconductive support and a method involving winding a thread-shaped member such as a wire around the outer peripheral surface of the electroconductive support.

It is preferred that, in order to obtain the effect of protecting the porous body, the density of the convex portion be set such that at least a part of the rigid structure is observed in a square region measuring 1.0 mm per side in a surface of the surface layer when observed from a direction facing the surface layer. There is no limitation on the size and thickness of the convex portion as long as the effects of the present invention are not impaired. Specifically, it is preferred that the size and thickness of the convex portion fall within a range in which an image defect is not caused by the presence of the convex portion. There is no limitation on the height of the convex portion as long as the height of the convex portion is larger than the thickness of the surface layer and the effects of the present invention are not impaired. Specifically, it is preferred that the height of the convex portion fall within a range in which the height of the convex portion is larger than at least the thickness of the surface layer and a charging defect is not caused by a large discharging gap.

[Separation Member]

There is no limitation on the separation member as long as the separation member can separate the photosensitive drum and the surface layer from each other and the effects of the present invention are not impaired. Examples of the separation member include a ring and a spacer.

As an example of a method of introducing the separation member, in the case where the electroconductive member has a roller shape, there is given a method involving introducing a ring having an outer diameter larger than that of the electroconductive member and having a hardness capable of holding a gap between the photosensitive drum and the electroconductive member. Further, as another example of the method of introducing a separation member, in the case where the electroconductive member has a blade shape, there is given a method involving introducing a spacer capable of separating the porous body and the photosensitive drum from each other so as to prevent friction and wearing between the porous body and the photosensitive drum.

There is no limitation on a material for forming the separation member as long as the effects of the present invention are not impaired. In addition, it is sufficient that a known non-electroconductive material be used appropriately in order to prevent electric conduction through the separation member. Examples of the material for the separation member include: polymer materials excellent in sliding property such as a polyacetal resin, a high-molecular-weight polyethylene resin, and a nylon resin; and metal oxide materials such as titanium oxide and aluminum oxide. One kind of those materials may be used alone, or two or more kinds thereof may be used in combination.

Figure 3:
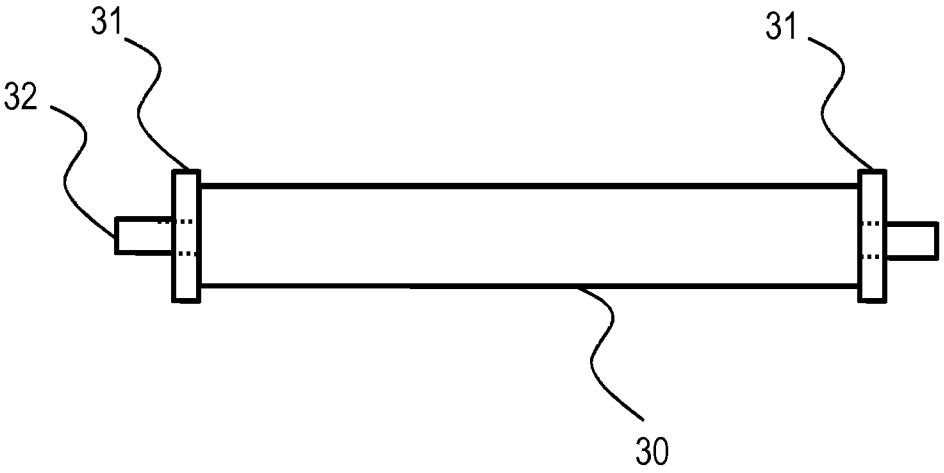
FIG. 3 is an explanatory view of an example (roller shape) in the case where the electroconductive member according to the present invention includes a separation member.

There is no limitation on a position at which the separation member is introduced as long as the effects of the present invention are not impaired, and for example, it is sufficient that the separation member be set at ends in a longitudinal direction of the electroconductive support. FIG. 3 illustrates an example (roller shape) of the electroconductive member in the case where the separation member is introduced. In FIG. 3, an electroconductive member is represented by reference numeral 30, a separation member is represented by reference numeral 31, and an electroconductive mandrel is represented by reference numeral 32.

<Process Cartridge>

Figure 4:
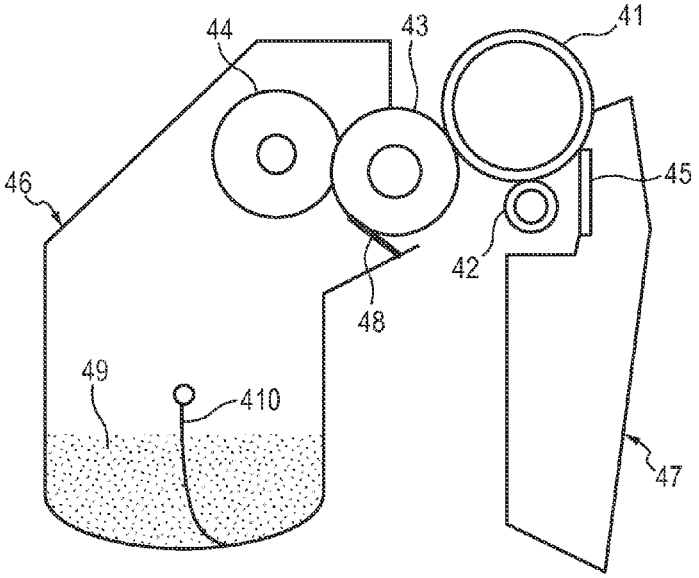
FIG. 4 is an explanatory view of a process cartridge using the electroconductive member according to the present invention.

FIG. 4 is a schematic sectional view of a process cartridge for electrophotography including the electroconductive member according to the present invention as a charging roller. The process cartridge includes a developing device and a charging device integrally and is configured so as to be removably mounted onto the main body of an electrophotographic apparatus. The developing device includes at least a developing roller 43 and a toner container 46 integrally, and as needed, may include a toner supply roller 44, a toner 49, a developing blade 48, and a stirring blade 410. The charging device includes at least a photosensitive drum 41, a cleaning blade 45, and a charging roller 42 integrally, and may include a waste toner container 47. The charging roller 42, the developing roller 43, the toner supply roller 44, and the developing blade 48 are each configured to be supplied with a voltage.

<Electrophotographic Apparatus>

Figure 5:
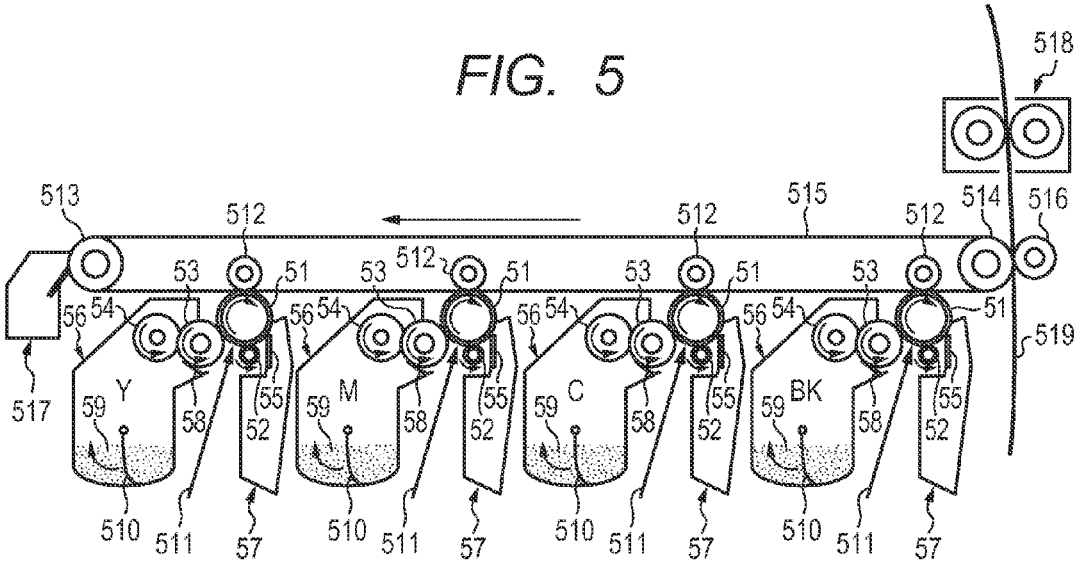
FIG. 5 is an explanatory view of an electrophotographic apparatus using the electroconductive member according to the present invention.

FIG. 5 is a schematic configuration view of an electrophotographic apparatus using the electroconductive member according to the present invention as a charging roller. The electrophotographic apparatus is a color electrophotographic apparatus having four of the above-mentioned process cartridges detachably mounted thereon. The respective process cartridges use toners of respective colors: black, magenta, yellow, and cyan. A photosensitive drum 51 rotates in an arrow direction and is uniformly charged by a charging roller 52 having a voltage from a charging bias power source applied thereto. Then, an electrostatic latent image is formed on a surface of the photosensitive drum 51 with exposure light 511. On the other hand, a toner 59 accommodated in a toner container 56 is supplied to a toner supply roller 54 by a stirring blade 510 and conveyed onto a developing roller 53. Then, the toner 59 is uniformly applied onto a surface of the developing roller 53 by a developing blade 58 that is held in contact with the developing roller 53, and charge is applied to the toner 59 by friction charging. The electrostatic latent image is developed with the toner 59 conveyed by the developing roller 53 that is held in contact with the photosensitive drum 51, with the result that the electrostatic latent image is visualized as a toner image.

The visualized toner image on the photosensitive drum is transferred onto an intermediate transfer belt 515, which is supported and driven by an tension roller 513 and an intermediate transfer belt drive roller 514, by a primary transfer roller 512 having a voltage from a primary transfer bias power source applied thereto. Toner images of the respective colors are successively superimposed on each other so as to form a color image on the intermediate transfer belt.

A transfer material 519 is fed into the apparatus by a sheet feed roller and conveyed to between the intermediate transfer belt 515 and a secondary transfer roller 516. A voltage is applied from a secondary transfer bias power source to the secondary transfer roller 516 so that the color image on the intermediate transfer belt 515 is transferred onto the transfer material 519. The transfer material 519 having the color image transferred thereon is subjected to fixing treatment by a fixing unit 518 and delivered out of the apparatus. Thus, a print operation is completed.

On the other hand, the toner remaining on the photosensitive drum without being transferred is scraped with a cleaning blade 55 so as to be accommodated in a waste toner accommodating container 57, and the photosensitive drum 51 thus cleaned repeats the above-mentioned steps. Further, the toner remaining on the primary transfer belt without being transferred is also scraped with a cleaning device 517.

EXAMPLES

Example 1

1. Preparation of Unvulcanized Rubber Composition

Respective materials of kinds and in amounts shown in Table 1 were mixed with a pressure kneader so as to obtain an A kneaded rubber composition. Further, 166 parts by mass of the A kneaded rubber composition and respective materials of kinds and in amounts shown in Table 2 were mixed with an open roll so as to prepare an unvulcanized rubber composition.

TABLE 1

| | Material | Blending amount (part(s) by mass) |
|---|---|---|
| Raw material rubber | NBR (trade name: Nipol DN219, manufactured by Zeon Corporation) | 100 |
| Electroconductive agent | Carbon black (trade name: TOKABLACK #7360SB, manufactured by Tokai Carbon Co., Ltd.) | 40 |

TABLE 1-continued

| | Material | Blending amount (part(s) by mass) |
|---|---|---|
| Filler | Calcium carbonate (trade name: NANOX #30, manufactured by Maruo Calcium Co., Ltd.) | 20 |
| Vulcanization accelerating aid | zinc oxide | 5 |
| Processing aid | stearic acid | 1 |

TABLE 2

| | Material | Blending amount (part(s) by mass) |
|---|---|---|
| Crosslinking agent | Sulfur | 1.2 |
| Vulcanization accelerator | Tetrabenzylthiuram disulfide (trade name: TBZTD, manufactured by SANSHIN CHEMICAL INDUSTRY CO., LTD.) | 4.5 |

2. Production of Electroconductive Support

[2-1. Electroconductive Mandrel]

A round bar made of free-cutting steel (having a total length of 252 mm, an outer diameter of 6 mm, and a surface subjected to electroless nickel plating) was prepared. Next, Metaloc U-20 (trade name, manufactured by TOYOKAGAKU KENKYUSHO CO., LTD.) was applied as an adhesive to an entire periphery of the round bar within a range of 230 mm, excluding both ends each having a length of 11 mm, with a roll coater. In this example, the round bar coated with the adhesive was used as an electroconductive mandrel.

[2-2. Electroconductive Resin Layer]

Next, a die having an inner diameter of 12.5 mm was mounted on a tip end of an extruder equipped with a crosshead having a supply mechanism of the electroconductive mandrel and a discharge mechanism of the unvulcanized rubber roller. Each temperature of the extruder and the crosshead was adjusted to 80° C., and the conveyance speed of the electroconductive mandrel was adjusted to 60 mm/sec. Under the conditions, the unvulcanized rubber composition was supplied through the extruder, and an outer periphery of the electroconductive mandrel was covered with the unvulcanized rubber composition in the crosshead, with the result that an unvulcanized rubber roller was obtained. Next, the unvulcanized rubber roller was put in a hot-air vulcanization furnace at 170° C. and heated for 60 minutes so as to vulcanize the unvulcanized rubber composition. Thus, a roller having an electroconductive resin layer formed on an outer periphery of the electroconductive mandrel was obtained. After that, both ends each having a length of 10 mm of the electroconductive resin layer were cut off so that the length of the electroconductive resin layer portion in a longitudinal direction became 231 mm. Finally, a surface of the electroconductive resin layer was polished with a rotary grindstone. Accordingly, an electroconductive support A1 having a diameter of 8.4 mm at each position of 90 mm from a center portion to both ends and a diameter of 8.5 mm at a center portion was obtained.

3. Formation of Surface Layer 6 g of PMMA (weight-average molecular weight: 996,000, manufactured by Sigma-Aldrich Co. LLC.) serving as a skeleton material for a porous body, 60 ml of distilled water serving as a solvent, and 240 ml of ethanol were added to a recovery flask. The mixture was heated to reflux while stirring so that PMMA was dissolved. Thus, a coating solution Al was prepared.

Then, the coating solution Al was applied to the electroconductive support A1 once by dip coating. The coating solution Al applied to the electroconductive support A1 was air-dried at 23° C. for 30 minutes or more and then dried for one hour with a hot-air circulating drier set to 60° C. During this drying process, phase separation between PMMA serving as a skeleton material and the solvent and evaporation of the solvent occurred simultaneously so that a porous body was formed. Thus, a surface layer including the porous body was formed on an outer peripheral surface of the electroconductive support A1. Accordingly, an electroconductive member A1 according to this example was obtained.

4. Evaluation of Characteristics

The electroconductive member A1 according to this example was subjected to the following evaluation test. Table 7 shows the evaluation results. Note that, in the case where the electroconductive member is a roller-shaped electroconductive member, an x-axis direction, a y-axis direction, and a z-axis direction respectively refer to the following directions.

The x-axis direction refers to a longitudinal direction of a roller (electroconductive member).

The y-axis direction refers to a tangential direction in a transverse cross section (that is, a circular cross section) of the roller (electroconductive member) orthogonal to an x-axis.

The z-axis direction refers to a diameter direction in the transverse cross section of the roller (electroconductive member) orthogonal to the x-axis.

Further, an "xy-plane" refers to a plane orthogonal to the z-axis, and a "yz-cross section" refers to a cross section orthogonal to the x-axis.

[4-1. Confirmation of Co-Continuous Structure]

Whether or not the porous body has a co-continuous structure was confirmed by the following method. A razor was brought into contact with the surface layer of the electroconductive member A1 so that a segment having a length of 250 μm each in an x-axis direction and in a y-axis direction and having a depth of 700 μm including the electroconductive support A1 in a z-axis direction was cut. Then, the segment was subjected to three-dimensional reconstruction with an X-ray CT inspection device (trade name: TOHKEN-SkyScan 2011 (radiation source: TX-300), manufactured by Mars Tohken X-ray Inspection Co., Ltd.). Two-dimensional slice images (parallel to an xy-plane) were cut from the three-dimensional image thus obtained at an interval of 1 μm with respect to a z-axis. Then, the slice images were binarized so that a skeleton portion and a pore portion were identified. The slice images were checked successively with respect to the z-axis, and thus it was confirmed that the skeleton portion and the pore portion were three-dimensionally continuous.

[4-2. Evaluation of Fineness (Surface Shape) of Surface Layer]

The fineness (surface shape) of the surface layer was evaluated as follows. Platinum was deposited from the vapor on a surface of the segment so as to obtain a deposited segment. Then, the surface of the deposited segment was photographed from the z-axis direction at a magnification of 1,000 times with a scanning electron microscope (SEM)

(trade name: S-4800, manufactured by Hitachi High-Technologies Corporation) so as to obtain a surface image.

Then, a region measuring 150 μm per side of the surface image was made into a gray scale and binarized with image processing software Imageproplus (product name, manufactured by Media Cybernetics, Inc.). Further, the resultant region of the surface image was subjected to edge detection so as to obtain a border line image in which a border line between the skeleton and the pore was extracted. In this case, the region of the surface image was processed so that the background had a white color and the border line had a black color. Then, black grid lines forming square parts each measuring 2.5 μm per side were produced on the white background so as to include 59 lines in a vertical direction and 59 lines in a horizontal direction, with the result that a grid image including a total of 3,600 white cells was formed. Further, the border line image and the grid image were overlapped with each other so as to obtain an evaluation image.

In the evaluation image, the square parts each measuring 2.5 μm per side formed of the skeleton and the square parts each measuring 2.5 μm per side formed of the pore did not include the border lines, and hence, in the evaluation image, a ratio of the number of the cells each having the same area as that of each grid of 2.5 μm, of the square parts formed of the skeleton and the square parts formed of the pore, was calculated by a count function of Imageproplus. The evaluation was performed based on the following criteria.

A: A ratio of a total of the square parts formed of the skeleton and the square parts formed of the pore with respect to all the square parts of the evaluation image is 5% or less.

B. A ratio of a total of the square parts formed of the skeleton and the square parts formed of the pore with respect to all the square parts of the evaluation image is more than 5% and 15% or less.

C. A ratio of a total of the square parts formed of the skeleton and the square parts formed of the pore with respect to all the square parts of the evaluation image is more than 15% and 25% or less.

D. A ratio of a total of the square parts formed of the skeleton and the square parts formed of the pore with respect to all the square parts of the evaluation image is more than 25%.

[4-3. Evaluation of Sectional Shape of Surface Layer]

The sectional shape of the surface layer was evaluated as follows. In a binarized image obtained by binarizing a two-dimensional slice image obtained by the X-ray CT measurement, the circularity K was calculated by $L^2/4\pi S$, where L represents a perimeter of each pore and S represents an area thereof.

The electroconductive member A1 was equally divided into 10 regions in a longitudinal direction. A sectional observation image of the surface layer was obtained from any one point in each of the 10 regions (10 points in total) and subjected to the above-mentioned evaluation. Then, an average value of the measured circularities was calculated and defined as an arithmetic mean of the circularity K of the electroconductive member Al.

[4-4. Evaluation of Non-Electroconductivity of Surface Layer (Porous Body)]

The non-electroconductivity of the surface layer (porous body) was evaluated as follows. The volume resistivity of the surface layer was measured in a contact mode through use of a scanning probe microscope (SPM) (trade name: Q-Scope 250, manufactured by Quesant Instrument Corporation).

First, a skeleton forming the porous body of the surface layer was collected from the electroconductive member A1 with tweezers, and a part of the collected skeleton was placed on a metal plate made of stainless steel so as to obtain a measurement segment. Next, a portion that was held in direct contact with the metal plate was selected, and a cantilever of the SPM was brought into contact with the portion. A voltage of 50 V was applied to the cantilever so that a current value was measured. Then, the surface shape of the measurement segment was observed with the SPM so as to obtain a height profile, and the thickness of the measurement segment was calculated from the obtained height profile. Further, the area of a concave part of the portion that was in held in contact with the cantilever was calculated from the surface shape observation result. The volume resistivity was calculated from the thickness and the area of the concave part and defined as the volume resistivity of the surface layer.

The electroconductive member A1 was equally divided into 10 regions in a longitudinal direction. A skeleton forming the porous body of the surface layer was collected from any one point in each of the 10 regions (10 points in total) with tweezers and subjected to the above-mentioned measurement. An average value of the measured volume resistivities was defined as the volume resistivity of the surface layer.

[4-5. Evaluation of Thickness of Surface Layer]

The thickness of the surface layer was evaluated as follows. A two-dimensional slice image obtained by the above-mentioned X-ray CT measurement was binarized so as to distinguish the porous body portion from the pore portion. A ratio of the porous body portion in each binarized slice image was converted into a numerical value, and numerical values were confirmed from the electroconductive support side to the surface layer side. A portion in which this ratio reached 2% or less was defined as an outermost surface portion of the surface layer. The thickness of the surface layer was measured by the above-mentioned method.

The above-mentioned operation was performed at any one point in each of 10 regions (10 points in total) obtained by equally dividing the electroconductive member Al into the 10 regions in a longitudinal direction, and an average thickness of the measured thicknesses was defined as the thickness of the surface layer.

[4-6. Evaluation of Porosity of Surface Layer]

The porosity of the surface layer was measured by the following method. A ratio of the pore portion in a three-dimensional image obtained by the above-mentioned X-ray CT evaluation was converted into a numerical value so as to obtain the porosity of the surface layer. The above-mentioned operation was performed at any one point in each of 10 regions (10 points in total) obtained equally dividing the electroconductive member A1 into the 10 regions in a longitudinal direction, and an average value of the measured porosities was defined as the porosity of the surface layer.

5. Evaluation of Image

The electroconductive member A1 was subjected to the following evaluation test. Table 7 shows the evaluation results.

[5-1. Evaluation of Void Image in Initial Period]

The effect of suppressing abnormal discharge in an initial period (before a durability test) of the electroconductive member A1 was confirmed by the following method. As an electrophotographic apparatus, an electrophotographic laser printer (trade name: Laserjet CP4525dn, manufactured by Hewlett-Packard Development Company, L.P.) was prepared. Note that, in order to put the electroconductive member in a more severe evaluation environment, the laser printer was remodeled so that the number of sheets to be output per unit time was 50 sheets/min, which was larger than the original number of sheets to be output, in terms of A4-size sheets. In this case, the output speed of a recording medium was set to 300 mm/sec, and the image resolution was set to 1,200 dpi.

Next, the electroconductive member A1 was mounted as a charging roller on a toner cartridge dedicated to the laser printer. The toner cartridge was loaded on the laser printer, and a half-tone image (image in which lateral lines were drawn at a width of one dot and an interval of two dots in a direction perpendicular to the rotation direction of the photosensitive drum) was output in the L/L environment (environment at a temperature of 15° C. and a relative humidity of 10%).

In this case, the voltage applied between the charging roller and the electrophotographic photosensitive member was set to −1,000 V so as to obtain an electrophotographic image. The electrophotographic image thus obtained was observed visually, and the presence or absence of image unevenness (void image) caused by local strong discharge from the charging member was observed.

Next, the output and visual evaluation of electrophotographic images were repeated in the same way as described above, except for changing the applied voltage in decrements of 10 V from −1,010 V, −1,020 V, −1,030 V, . . . . Then, the applied voltage was measured at a time when an electrophotographic image, in which image unevenness (void image) caused by local strong discharge from the charging member was able to be confirmed visually, was formed. The applied voltage in this case was described in Table 7 as a void image generation voltage (V1) before the durability test.

[5-2. Evaluation of Void Image after Durability Test]

Next, the durability test was performed in the L/L environment through use of the above-mentioned laser printer having the electroconductive member A1 mounted thereon as a charging roller. In the durability test, 40,000 sheets of an electrophotographic image were output by repeating an intermittent image forming operation involving outputting two sheets of an image, suspending the rotation of the photosensitive drum for about 3 seconds, and resuming the output of the image. In this case, an output image was such that an alphabet "E" letter having a size of 4 points was printed so as to have a coverage of 4% with respect to the area of an A4-size sheet.

After the durability test, an applied voltage was measured at a time when an electrophotographic image, in which a void image was able to be confirmed, was formed, by the same method as that before the durability test. The applied voltage in this case was described in Table 7 as a void image generation voltage (V2) after the durability test. Further, a ratio (V2/V1) of the void image generation voltage (V2) after the durability test with respect to the void image generation voltage (V1) before the durability test was calculated. The obtained V2/V1 was described in Table 7.

[5-3. Evaluation of Horizontal Streak-Like Image after Durability Test]

The effect of the electroconductive member A1 of suppressing a horizontal streak-like image after the durability test was confirmed by the following method. The same durability test as that performed for evaluating a void image after the durability test was performed through use of the above-mentioned laser printer used for evaluating a void image having the electroconductive member Al mounted thereon as a charging roller.

After the durability test, the process cartridge was disassembled so as to remove the electroconductive member A1, and the electroconductive member A1 was left to stand in the L/L environment for 48 hours or more. Then, the electroconductive member A1 was incorporated as a charging roller into the process cartridge again so as to output a half-tone image in the L/L environment. The obtained image was confirmed for a horizontal streak-like image defect and evaluated based on the following criteria.

[Evaluation of Horizontal Streak-Like Image]

A: No horizontal streak-like image is found in the image.

B: A slight horizontal streak-like white line is observed in a part of the image.

C: A slight horizontal streak-like white line is found on an entire surface of the image.

D: A horizontal streak-like white line is found and conspicuous.

Examples 2 to 9

Electroconductive members A2 to A9 were produced and evaluated in the same way as in Example 1, except for changing the weight-average molecular weight and blending amount of PMMA serving as a skeleton material for the porous body as shown in Table 3. Table 7 shows the evaluation results.

TABLE 3

| | Skeleton material for porous body | | |
|---|---|---|---|
| | Kind of material | Weight-average molecular weight | Blending amount (g) |
| Example 1 | PMMA | 996,000 | 6.0 |
| Example 2 | PMMA | 996,000 | 9.3 |
| Example 3 | PMMA | 996,000 | 26.1 |
| Example 4 | PMMA | 996,000 | 40.9 |
| Example 5 | PMMA | 350,000 | 9.3 |
| Example 6 | PMMA | 120,000 | 9.3 |
| Example 7 | PMMA | 15,000 | 1.5 |
| Example 8 | PMMA | 15,000 | 3.0 |
| Example 9 | PMMA | 15,000 | 6.1 |

Example 10

An electroconductive member A10 was produced and evaluated in the same way as in Example 1, except for adding 0.19 g of carbon black (HAF) as an additive to the coating solution Al so that carbon black was dispersed in the coating solution Al. Table 7 shows the evaluation results.

Example 11

An electroconductive member A11 was produced and evaluated in the same way as in Example 1, except for preparing an unvulcanized rubber composition through use of materials shown in Table 4 as the materials for an unvulcanized rubber. Table 7 shows the evaluation results.

TABLE 4

| Material | Blending amount (part(s) by mass) |
|---|---|
| Epichlorohydrin-ethylene oxide-allyl glycidyl ether terpolymer (GECO) (trade name: EPICHLOMER CG-102, manufactured by DAISO CO., LTD.) | 100 |
| Zinc oxide (Zinc Oxide Type II, manufactured by SEIDO CHEMICAL INDUSTRY CO., LTD.) | 5 |
| Calcium carbonate (trade name: Silver-W, manufactured by SHIRAISHI CALCIUM KAISHA, LTD.) | 35 |
| Carbon black (trade name: SEAST SO, manufactured by Tokai Carbon Co., Ltd.) | 0.5 |
| Stearic acid | 2 |
| Adipic acid ester (trade name: POLYCIZER W305 ELS, manufactured by DIC Corporation) | 10 |
| Sulfur | 0.5 |
| Dipentamethylenethiuram tetrasulfide (NOCCELER TRA, manufactured by OUCHI SHINKO CHEMICAL INDUSTRIAL CO., LTD.) | 2 |

Example 12

An electroconductive member A12 was produced and evaluated in the same way as in Example 1, except for further forming an electroconductive resin layer on an outer peripheral surface of the electroconductive support Al in accordance with the following method. Table 7 shows the evaluation results. First, methyl isobutyl ketone was added to a caprolactone-modified acrylic polyol solution so as to adjust the solid content to 10 mass %. Then, a mixed solution was prepared by using materials shown in Table 5 with respect to 1,000 parts by mass (solid content: 100 parts by mass) of the acrylic polyol solution. In this case, a mixture of block HDI and block IPDI was "NCO/OH=1.0".

TABLE 5

| Material | Blending amount (part(s) by mass) |
|---|---|
| Caprolactone-modified acrylic polyol solution | 100 (solid content) |
| Carbon black (HAF) | 15 |
| Acicular rutile-type titanium oxide fine particles | 35 |
| Modified dimethyl silicone oil | 0.1 |
| Mixture of butanone oxime-blocked products of hexamethylene diisocyanate (HDI) and isophorone diisocyanate (IPDI) at ratio of 7:3 | 80.14 |

Then, 210 g of the above-mentioned mixed solution and 200 g of glass beads having an average particle diameter of 0.8 mm serving as a medium were mixed in a 450-mL glass bottle, and the mixture was pre-dispersed for 24 hours with a paint shaker disperser so as to obtain a paint for forming an electroconductive resin layer.

The electroconductive support A1 was immersed in the paint for forming an electroconductive resin layer so as to be coated with the paint by dip coating, with a longitudinal direction thereof being directed in a vertical direction. The immersion time for dip coating was 9 seconds, and the take-up speed was set to 20 mm/sec as an initial speed and 2 mm/sec as a final speed. The take-up speed was changed linearly with respect to time between the initial speed and the final speed. The coated object thus obtained was air-dried at normal temperature for 30 minutes. Then, the coated object was dried in a hot-air circulating drier set to 90° C. for 1 hour and further dried in the hot-air circulating drier set to 160° C. for 1 hour.

Example 13

An electroconductive member A13 was produced and evaluated in the same way as in Example 1, except for using only the round bar as the electroconductive support. Note that, in order to perform evaluation, the cartridge was changed so that the electroconductive member A13 was brought into contact with the photosensitive drum. Table 7 show the evaluation results.

Example 14

The paint for forming an electroconductive resin layer of Example 12 was applied onto a sheet made of aluminum having a thickness of 200 μm by dip coating under the same condition as that of Example 12 so as to form an electroconductive resin layer on the sheet made of aluminum. Thus, a blade-shaped electroconductive support was produced. Next, a surface layer was formed on an outer peripheral surface of the blade-shaped electroconductive support in the same way as in Example 1 so as to produce an electroconductive member A14.

The electroconductive member A14 was mounted as a charging blade on the same electrophotographic laser printer as that used for evaluating an image in Example 1 and arranged so as to abut against the photosensitive drum in a forward direction with respect to the rotation direction of the photosensitive drum. Note that, an angle θ formed by a contact point at the abutment point of the electroconductive member A14 with respect to the photosensitive drum and the charging blade was set to 20° from the viewpoint of chargeability. Further, an abutment pressure of the electroconductive member A14 with respect to the photosensitive drum was initially set to 20 g/cm (linear pressure). An image was evaluated under the same conditions as those of Example 1. Table 7 shows the evaluation results.

Example 15

An electroconductive member A15 was produced and evaluated in the same way as in Example 14, except that the electroconductive resin layer was not formed. Table 7 shows the evaluation results.

Example 16

An electroconductive member A16 was produced and evaluated in the same way as in Example 1, except for forming the surface layer by the following method. 6 g of cellulose acetate (trade name: L-70, acetylation degree: 55%, manufactured by Daicel Corporation) serving as a skeleton material for a porous body, 253.5 g of acetone serving as a solvent, and 46.5 g of 1-octanol were added to a recovery flask. The mixture was stirred so that cellulose acetate was dissolved, and thus a coating solution was prepared. The coating solution was applied to the electroconductive support A1 once by dip coating and air-dried at 23° C. for 30 minutes or more. Then, the coating solution was dried in a hot-air circulating drier set to 140° C. for 1 hour so as to produce an electroconductive member A16. Table 7 shows the evaluation results.

Examples 17 to 23

Electroconductive members A17 to A23 were produced and evaluated in the same way as in Example 16, except for changing the kind and blending amount of cellulose acetate serving as a skeleton material for a porous body as shown in Table 6. Table 7 shows the evaluation results. Note that, cellulose acetate (trade name: L-30, acetylation degree: 55%, manufactured by Daicel Corporation) was used in Example 20, and cellulose acetate (trade name: L-20, acetylation degree: 55%, manufactured by Daicel Corporation) was used in Examples 21 to 23.

TABLE 6

| | Skeleton material for porous body | |
|---|---|---|
| | Kind of material | Blending amount (g) |
| Example 16 | Cellulose acetate L-70 | 6.0 |
| Example 17 | Cellulose acetate L-70 | 8.7 |
| Example 18 | Cellulose acetate L-70 | 24.5 |
| Example 19 | Cellulose acetate L-70 | 38.5 |
| Example 20 | Cellulose acetate L-30 | 8.7 |
| Example 21 | Cellulose acetate L-20 | 1.4 |
| Example 22 | Cellulose acetate L-20 | 5.8 |
| Example 23 | Cellulose acetate L-20 | 21.2 |

Example 24

An electroconductive member A24 was produced and evaluated in the same way as in Example 1, except for forming the surface layer by the following method. 12 g of polyvinyl alcohol (weight-average molecular weight: 89,000 to 98,000, saponification degree: 99 mol %, manufactured by Sigma-Aldrich Co. LLC.) serving as a skeleton material for a porous body were supplied to a recovery flask, and 114 mL of water were added thereto. The mixture was stirred and heated to reflux so as to obtain an aqueous solution. The aqueous solution was cooled to 50° C., and a mixed solvent of 57.5 ml of water and 128.5 ml of acetone was added to the resultant aqueous solution so as to prepare a PVA solution. The PVA solution was poured into a mold in which the electroconductive support A1 was set and sealed. The mold was left to stand still at 20° C. for 12 hours. The resultant was washed with isopropyl alcohol three times so that water in the mixed solvent was replaced by isopropyl alcohol. The resultant was dried under reduced pressure at normal temperature for 24 hours so as to remove isopropyl alcohol, and thus an electroconductive member A24 was produced. Table 7 shows the evaluation results.

Example 25

An electroconductive member A25 was produced and evaluated in the same way as in Example 1, except for forming the surface layer by the following method. 19.3 g of styrene, 3.3 g of divinylbenzene, 1.1 g of sorbitan monooleate, and 0.14 g of 2,2'-azodiisobutyronitrile were mixed so as to obtain a homogeneous solution. The solution thus obtained and 180 g of water were stirred with a planetary centrifugal mixer so as to prepare a W/O emulsion solution. The emulsion solution was poured into a mold, in which the electroconductive support A1 was set. After purging with nitrogen, the mold was sealed and the resultant emulsion solution was polymerized at 60° C. for 24 hours. The resultant was removed from the mold and washed with 2-propanol. The resultant was dried in an oven at 85° C. so as to produce an electroconductive member A25. Table 7 shows the evaluation results.

Example 26

An electroconductive member A26 was produced and evaluated in the same way as in Example 1, except for forming the surface layer by the following method. 3 g of 1,3-bis(N,N'-diglycidylaminomethylcyclohexane) (trade name: TETRAD-C, manufactured by Mitsubishi Gas Chemical Company, Inc.), 3 g of polyamidoamine (trade name: Tohmide 245-S, manufactured by T&K TOKA Corporation, and 18 g of polyethylene glycol (weight-average molecular weight: 1,000) were added to a recovery flask. The mixture was stirred and dissolved so as to prepare a coating solution.

The coating solution was applied to the electroconductive support A1 once by dip coating and dried at 70° C. for 24 hours. Then, the resultant was dried in a hot-air circulating drier set to 100° C. for 3 hours so that a surface layer was formed on an outer peripheral surface of the electroconductive support A1. Further, the surface layer was immersed in distilled water so as to elute polyethylene glycol, and thus an electroconductive member A26 was produced. Table 7 shows the evaluation results.

Example 27

An electroconductive member A27 was produced and evaluated in the same way as in Example 1, except for forming the surface layer by the following method. 120 g of XOLTEX PX-550 (manufactured by DIC Corporation), 60 g of toluene, and 30 g of methyl ethyl ketone were added to a recovery flask, and the mixture was stirred. Then, a mixed solvent containing 54 g of water and 6 g of methyl ethyl ketone was supplied to the mixture in five portions, and the resultant was stirred so as to prepare a W/O emulsion solution.

The W/O emulsion solution was applied to the electroconductive support A1 once by dip coating and air-dried at 70° C. for 2 minutes. Then, the resultant was dried in a hot-air circulating drier set to 120° C. for 1 hour so that a surface layer was formed on an outer peripheral surface of the electroconductive support A1. Table 7 shows the evaluation results.

Example 28

An electroconductive member A28 was produced and evaluated in the same way as in Example 1, except for forming the surface layer by the following method. 25 ml of a 0.01 mol/L acetic acid aqueous solution were added to 2.1 g of polyethylene glycol (weight-average molecular weight: 10,000) so that polyethylene glycol was dissolved in the aqueous solution. The solution thus obtained was cooled with ice. 12 ml of tetramethoxysilane were added to the resultant solution and the mixture was stirred for 1 hour. The solution was poured into a mold in which the electroconductive support A1 was set, and the mold was sealed. The mold was left to stand still at 40° C. for 24 hours so that a surface layer was formed on an outer peripheral surface of the electroconductive support A1. The resultant was removed from the mold. Then, the resultant was immersed in a 50% ethanol aqueous solution and left to stand for 1 day. Then, the resultant was immersed in a 0.5 mol/L urea aqueous solution and heated to reflux. Then, the resultant was dried in an oven at 40° C. so as to obtain an electroconductive member A28. Table 7 shows the evaluation results.

Example 29

An electroconductive member A29 was produced and evaluated in the same way as in Example 12 except for adding 10 parts by mass of cross-linking type acrylic particles (trade name: GR300W, manufactured by Negami Chemical Industrial Co., Ltd.) to the mixed solution of Example 12 with respect to 100 parts by mass of the solid content of the caprolactone-modified acrylic polyol solution. Table 7 shows the evaluation results. In this example, when the cross-linking type acrylic particles were dispersed in an electroconductive resin layer, the electroconductive resin layer was brought into contact with the photosensitive drum at each peak of the particles, with the result that a gap having a size of about 7 μm on average was formed between the electroconductive member A29 and the photosensitive drum. Further, a distance between the particles was about 20 μm on average.

Example 30

An electroconductive member A30 was produced and evaluated in the same way as in Example 12, except for roughening a surface of the electroconductive resin layer of Example 12 by sandblasting. Table 7 shows the evaluation results. In this example, the surface of the electroconductive resin layer was roughened to form convex portions so that the electroconductive resin layer was brought into contact with the photosensitive drum at each peak of the convex portions, with the result that a gap having a size of about 8 μm on average was formed between the electroconductive member A30 and the photosensitive drum. Further, a distance between the convex portions was about 10 μm on average.

Example 31

As illustrated in FIG. 3, an electroconductive member A31 was produced and evaluated in the same way as in Example 1, except for mounting a ring made of polyoxymethylene having an outer diameter of 8.6 mm, an inner diameter of 6.0 mm, and a width of 2 mm to each outer side in a longitudinal direction of the electroconductive resin layer of the electroconductive member A1 and bonding the ring to the mandrel with an adhesive so that the ring rotates following the mandrel. Table 7 shows the evaluation results. In this example, the separation member was introduced and brought into contact with the photosensitive drum, with the result that a gap having a size of 50 μm on average was formed between the electroconductive member A31 and the photosensitive drum.

Example 32

The electroconductive member A1 was left to stand for 48 hours or more in an environment of a temperature of 15° C. and a relative humidity of 10% R.H., and then was incorporated as a transfer roller into an electrophotographic apparatus Laserjet P4515n manufactured by Hewlett-Packard Development Company, L.P. As a result, a void image caused by abnormal discharge and a horizontal streak-like image were not generated.

TABLE 7

| | Electroconductive support | | | Evaluation of physical properties | | | |
|---|---|---|---|---|---|---|---|
| | | | | | Total of square parts formed of | | |
| | Shape | Material for electroconductive resin layer | Surface layer Skeleton material for porous body | Co-continuous structure | skeleton and square parts formed of pore | Electrical resistivity (Ωcm) | Arithmetic mean of circularity K |
| Example 1 | Round bar | NBR | PMMA | Present | A | 9.5.E+16 | 4.19 |
| Example 2 | Round bar | NBR | PMMA | Present | A | 3.2.E+16 | 4.13 |
| Example 3 | Round bar | NBR | PMMA | Present | A | 7.7.E+16 | 4.12 |
| Example 4 | Round bar | NBR | PMMA | Present | A | 7.0.E+16 | 4.31 |
| Example 5 | Round bar | NBR | PMMA | Present | B | 7.0.E+16 | 3.49 |
| Example 6 | Round bar | NBR | PMMA | Present | B | 4.3.E+16 | 2.37 |
| Example 7 | Round bar | NBR | PMMA | Present | C | 1.4.E+16 | 2.32 |
| Example 8 | Round bar | NBR | PMMA | Present | C | 2.8.E+16 | 2.15 |
| Example 9 | Round bar | NBR | PMMA | Present | C | 9.2.E+16 | 2.22 |
| Example 10 | Round bar | NBR | PMMA | Present | A | 2.2.E+10 | 4.39 |
| Example 11 | Round bar | Hydrin | PMMA | Present | A | 1.6.E+16 | 4.35 |
| Example 12 | Round bar | NBR + Urethane | PMMA | Present | A | 3.1.E+16 | 4.32 |
| Example 13 | Round bar | — | PMMA | Present | A | 4.9.E+16 | 4.43 |
| Example 14 | Blade | Urethane | PMMA | Present | A | 5.2.E+16 | 4.25 |
| Example 15 | Blade | — | PMMA | Present | A | 5.7.E+16 | 4.20 |
| Example 16 | Round bar | NBR | Cellulose acetate L-70 | Present | A | 5.7.E+14 | 4.07 |
| Example 17 | Round bar | NBR | Cellulose acetate L-70 | Present | A | 4.8.E+14 | 4.36 |
| Example 18 | Round bar | NBR | Cellulose acetate L-70 | Present | A | 9.4.E+14 | 4.49 |
| Example 19 | Round bar | NBR | Cellulose acetate L-70 | Present | A | 5.2.E+14 | 4.04 |
| Example 20 | Round bar | NBR | Cellulose acetate L-30 | Present | B | 2.0.E+14 | 3.27 |
| Example 21 | Round bar | NBR | Cellulose acetate L-20 | Present | C | 5.5.E+14 | 2.38 |
| Example 22 | Round bar | NBR | Cellulose acetate L-20 | Present | C | 9.3.E+14 | 2.00 |
| Example 23 | Round bar | NBR | Cellulose acetate L-20 | Present | C | 3.8.E+14 | 2.03 |
| Example 24 | Round bar | NBR | PVOH | Present | A | 1.3.E+13 | 4.47 |
| Example 25 | Round bar | NBR | Styrene | Present | A | 8.6.E+12 | 1.42 |
| Example 26 | Round bar | NBR | Epoxy | Present | A | 3.2.E+11 | 4.37 |
| Example 27 | Round bar | NBR | Urethane | Present | A | 9.0.E+14 | 4.26 |
| Example 28 | Round bar | NBR | Silica | Present | A | 7.3.E+16 | 4.28 |
| Example 29 | Round bar | NBR | PMMA | Present | A | 2.8E+16 | 4.25 |

TABLE 7-continued

| | | | | | | | |
|---|---|---|---|---|---|---|---|
| Example 30 | Round bar | NBR | PMMA | Present | A | 3.4E+16 | 4.11 |
| Example 31 | Round bar | NBR | PMMA | Present | A | 6.5E+16 | 4.33 |

| | Evaluation of physical properties | | Evaluation of image: Void image generation voltage | | | |
|---|---|---|---|---|---|---|
| | | | Initial | After durability | | |
| | Porosity (%) | Thickness of surface layer (μm) | period V1 (V) | test V2 (V) | V2/V1 | Horizontal streak |
| Example 1 | 86 | 3.1 | −1,900 | −1,860 | 0.98 | B |
| Example 2 | 85 | 11.2 | −2,000 | −1,960 | 0.98 | A |
| Example 3 | 88 | 30.5 | −2,000 | −1,950 | 0.98 | A |
| Example 4 | 88 | 48.2 | −2,000 | −1,940 | 0.97 | B |
| Example 5 | 79 | 10.5 | −2,000 | −1,960 | 0.98 | A |
| Example 6 | 74 | 11.5 | −2,000 | −1,950 | 0.98 | B |
| Example 7 | 69 | 3.5 | −1,900 | −1,860 | 0.98 | C |
| Example 8 | 70 | 10.8 | −2,000 | −1,960 | 0.98 | B |
| Example 9 | 71 | 49.7 | −2,000 | −1,910 | 0.96 | C |
| Example 10 | 86 | 10.3 | −1,500 | −1,450 | 0.97 | C |
| Example 11 | 88 | 11.3 | −2,000 | −1,980 | 0.99 | A |
| Example 12 | 84 | 10.7 | −2,000 | −1,960 | 0.98 | A |
| Example 13 | 88 | 12.1 | −1,900 | −1,860 | 0.98 | A |
| Example 14 | 87 | 10.9 | −2,000 | −1,980 | 0.99 | B |
| Example 15 | 81 | 11.5 | −1,900 | −1,880 | 0.99 | B |
| Example 16 | 84 | 3.4 | −1,900 | −1,890 | 0.99 | B |
| Example 17 | 86 | 10.6 | −2,000 | −1,950 | 0.98 | A |
| Example 18 | 82 | 30.7 | −2,000 | −1,920 | 0.96 | A |
| Example 19 | 85 | 47.9 | −2,000 | −1,910 | 0.96 | B |
| Example 20 | 78 | 10.1 | −2,000 | −1,970 | 0.99 | A |
| Example 21 | 68 | 3.8 | −1,900 | −1,850 | 0.97 | C |
| Example 22 | 62 | 11.8 | −2,000 | −1,960 | 0.98 | B |
| Example 23 | 61 | 48.6 | −2,000 | −1,950 | 0.98 | C |
| Example 24 | 88 | 10.7 | −1,800 | −1,750 | 0.97 | A |
| Example 25 | 84 | 10.1 | −1,600 | −1,540 | 0.96 | C |
| Example 26 | 82 | 11.1 | −1,500 | −1,460 | 0.97 | C |
| Example 27 | 73 | 10.2 | −1,900 | −1,840 | 0.97 | B |
| Example 28 | 77 | 10.4 | −2,000 | −1,960 | 0.98 | A |
| Example 29 | 82 | 10.5 | −1,900 | −1,900 | 1 | A |
| Example 30 | 79 | 10.1 | −1,900 | −1,900 | 1 | A |
| Example 31 | 85 | 10.6 | −1,900 | −1,900 | 1 | A |

Comparative Example 1

An electroconductive member B1 was produced and evaluated in the same way as in Example 12, except that 19.2 g of cross-linking type acrylic particles (trade name: GR300W, manufactured by Negami Chemical Industrial Co., Ltd.) were added to the mixed solution of Example 12 and a surface layer including a porous body was not formed on an outer peripheral surface of a urethane resin layer formed of the mixed solution. Table 8 shows the evaluation results.

Comparative Example 2

An electroconductive adhesive was applied onto the electroconductive support A1 of Example 1 with a roll coater and a nylon mesh (trade name: NY10-HC, manufactured by Semitec Corporation) was attached to the coated electroconductive support A1 so as to produce an electroconductive member B2. The electroconductive member B2 was evaluated in the same way as in Example 1. Table 8 shows the evaluation results.

Comparative Example 3

An electroconductive member B3 was produced and evaluated in the same way as in Example 12, except that 19.2 g of a chemical foaming agent (trade name: Cellmic 266, Sankyo Kasei Co., Ltd.) were added to the mixed solution of Example 12 and carbon black was not added thereto, and that a surface layer including a porous body was not formed on an outer peripheral surface of a urethane resin layer formed of the mixed solution. Table 8 shows the evaluation results.

Comparative Example 4

An electroconductive member B4 was produced and evaluated in the same way as in Example 12, except that 19.2 g of an unexpanded microcapsule (trade name: Expancel 031-40, Japan Fillite Co., Ltd.) were added to the mixed solution of Example 12 and carbon black was not added thereto, and that a surface layer including a porous body was not formed on an outer peripheral surface of a urethane resin layer formed of the mixed solution. Table 8 shows the evaluation results.

Comparative Example 5

An electroconductive member B5 was produced and evaluated in the same way as in Example 12, except that 19.2 g of a chemical foaming agent (trade name: "Cellmic 266", Sankyo Kasei Co., Ltd.) were added to the mixed solution of Example 12, and that a surface layer including a porous body was not formed on an outer peripheral surface of a urethane resin layer formed of the mixed solution. Table 8 shows the evaluation results.

TABLE 8

| | Electroconductive support | | | Evaluation of physical properties | | | |
|---|---|---|---|---|---|---|---|
| | Shape | Material for electroconductive resin layer | Surface layer Production method | Co-continuous structure | Total of square parts formed of skeleton and square parts formed of pore | Electrical resistivity (Ωcm) | Arithmetic mean of circularity K |
| Comparative Example 1 | Round bar | NBR | Roughening particles | Absent | D | 6.5.E+06 | 1.26 |
| Comparative Example 2 | Round bar | NBR | Insulating mesh | Absent | D | 1.1.E+16 | 1.39 |
| Comparative Example 3 | Round bar | NBR | Open cell | Present | D | 2.3.E+16 | 1.45 |
| Comparative Example 4 | Round bar | NBR | Closed cell | Absent | D | 1.9.E+16 | 1.02 |
| Comparative Example 5 | Round bar | NBR | Electroconductive foaming | Absent | D | 2.6.E+06 | 2.35 |

| | Evaluation of physical properties | | Evaluation of image | | | |
|---|---|---|---|---|---|---|
| | | | Void image generation voltage | | | |
| | Porosity (%) | Thickness of surface layer (μm) | Initial period V1 (V) | After durability test V2 (V) | V2/V1 | Horizontal streak |
| Comparative Example 1 | 0 | 12.6 | −1,100 | −1,050 | 0.95 | C |
| Comparative Example 2 | 80 | 11.2 | −1,300 | −1,230 | 0.95 | C |
| Comparative Example 3 | 75 | 10.5 | −1,300 | −1,250 | 0.96 | C |
| Comparative Example 4 | 70 | 14.5 | −1,350 | −1,300 | 0.96 | D |
| Comparative Example 5 | 68 | 12.3 | −1,100 | −1,060 | 0.96 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202663, filed Sep. 27, 2013, which is hereby incorporated by reference herein in its entirety.

What is claimed is:

1. An electroconductive member for electrophotography, comprising at least:

an electroconductive support; and a surface layer on an outer side of the electroconductive support, wherein the surface layer comprises a porous body and satisfies the following (1), (2), and (3):

(1) the porous body has a co-continuous structure including a skeleton that is three-dimensionally continuous and a pore that is three-dimensionally continuous;

(2) when an arbitrary square region having one side length of 150 μm of a surface of the surface layer is photographed, and the region is equally divided into 60 parts vertically and equally divided into 60 parts horizontally so that the region is equally divided into 3,600 square parts, a ratio of a total sum of a number of the square parts of the skeleton and a number of the square parts of the pore with respect to a number of all the square parts is 25% or less; and (3) the porous body is non-electroconductive.

2. An electroconductive member for electrophotography according to claim 1, wherein the electroconductive member for electrophotography has an arithmetic mean of a circularity K of 2 or more, which is determined by $L^2/4\pi S$, where L represents a perimeter of the pore in a photographed sectional image of the surface layer and S represents an area of the pore in the photographed sectional image of the surface layer.

3. An electroconductive member for electrophotography according to claim 1, wherein the surface layer has a thickness of 3 μm or more and 50 μm or less.

4. An electroconductive member for electrophotography according to claim 1, wherein the surface layer has a porosity of 40% or more and 95% or less.

5. An electroconductive member for electrophotography according to claim 1, wherein the surface layer has a volume resistivity of $1\times10^{10}$ Ω·cm or more and $1\times10^{12}$ Ω·cm or less.

6. An electroconductive member for electrophotography according to claim 1, wherein the porous body is formed by phase separation between a polymer material and a solvent.

7. An electroconductive member for electrophotography according to claim 1, further comprising a rigid structural body for protecting the surface layer.

8. A process cartridge detachably mountable to a main body of an electrophotographic apparatus, the process cartridge comprising the electroconductive member according to claim 1.

9. An electrophotographic apparatus, comprising the electroconductive member according to claim 1.

* * * * *